US011872458B2

(12) United States Patent
McMillan

(10) Patent No.: US 11,872,458 B2
(45) Date of Patent: Jan. 16, 2024

(54) HITTING AND PITCHING TRAINING DEVICE

(71) Applicant: Derrick McMillan, Gautier, MS (US)

(72) Inventor: Derrick McMillan, Gautier, MS (US)

( * ) Notice: Subject to any disclaimer, the term of this patent is extended or adjusted under 35 U.S.C. 154(b) by 2 days.

(21) Appl. No.: 17/700,587

(22) Filed: Mar. 22, 2022

(65) Prior Publication Data

US 2022/0296978 A1 Sep. 22, 2022

Related U.S. Application Data

(60) Provisional application No. 63/164,014, filed on Mar. 22, 2021.

(51) Int. Cl.

| | |
|---|---|
| ***A63B 69/36*** | (2006.01) |
| ***A63B 69/00*** | (2006.01) |
| *A63B 71/06* | (2006.01) |

(52) U.S. Cl.

CPC .. *A63B 69/0002* (2013.01); *A63B 2069/0006* (2013.01); *A63B 2071/0694* (2013.01); *A63B 2210/50* (2013.01); *A63B 2225/093* (2013.01)

(58) Field of Classification Search

CPC ..... A63B 69/0002; A63B 2069/0006; A63B 2071/0694; A63B 2210/50; A63B 2225/093

USPC ..... 473/212, 215, 221, 226, 229, 266

See application file for complete search history.

(56) References Cited

U.S. PATENT DOCUMENTS

| | | | | |
|---|---|---|---|---|
| 2,305,754 | A * | 12/1942 | Woodruff, Jr. | A47F 5/02 211/45 |
| 3,312,467 | A | 4/1967 | Dawson | |
| 4,173,337 | A * | 11/1979 | Okonowski | A63B 69/0002 473/456 |
| 4,516,771 | A | 5/1985 | Nau | |
| 5,303,914 | A * | 4/1994 | Cooksey | A63B 69/0091 473/429 |
| 7,220,194 | B1 * | 5/2007 | Laiacona, Jr. | A63B 63/00 473/454 |
| 8,206,235 | B1 * | 6/2012 | Sardo | A63B 69/3629 473/268 |
| 8,720,706 | B2 * | 5/2014 | Robbins, III | A47F 5/02 211/195 |
| 9,375,622 | B2 | 6/2016 | Bond | |
| 2011/0224029 | A1 | 9/2011 | Day et al. | |
| 2015/0094173 | A1 | 4/2015 | Kammer | |
| 2016/0129329 | A1 * | 5/2016 | Fadde | A63B 69/0002 473/417 |
| 2018/0099198 | A1 * | 4/2018 | Bird | A63B 69/0002 |

* cited by examiner

*Primary Examiner* — Nini F Legesse

(74) *Attorney, Agent, or Firm* — Global Intellectual Property Agency; Daniel Boudwin

(57) ABSTRACT

A hitting and pitching training device is provided. The hitting and pitching training device includes a base stand. A vertical shaft extends upward from the base stand. A first horizontal bar extends laterally outward from the vertical shaft. A second horizontal bar extends laterally outward from the vertical shaft. The first horizontal bar is positioned at a greater vertical elevation than the second horizontal bar. The first horizontal bar and the second horizontal bar can be vertically adjusted along the length of the vertical shaft. The first horizontal bar and the second horizontal bar are rotatable around the vertical shaft. The first horizontal bar and the second horizontal bar define a strike zone in between.

7 Claims, 2 Drawing Sheets

HITTING AND PITCHING TRAINING DEVICE

CROSS REFERENCE TO RELATED APPLICATIONS

This application claims the benefit of U.S. Provisional Application No. 63/164,104 filed on Mar. 22, 2021. The above identified patent application is herein incorporated by reference in its entirety to provide continuity of disclosure.

BACKGROUND OF THE INVENTION

The present invention relates to a hitting and pitching training device. More specifically, the present invention provides a stand designed to define a strike zone for an individual practicing hitting or pitching.

Children and adults that participate in baseball or softball leagues may want to improve their skills and abilities. Having a familiarity with the size of the strike zone can help both hitters and pitchers succeed in these sports. However, identifying the strike zone is a difficult thing to do for players of all skill levels and requires extensive practice to identify a general strike zone for improving their respective skills. Current methods to help players identifying the strike zone may be ineffective as training aides because they cannot clearly see and identify the strike zone. Providing the players with a physical display of the strike zone will allow them to gain familiarity of the strike zone. The players will be able to develop a muscle memory of where to swing the bat or pitch the ball so when they play in games, they will be more effective as a hitter or pitcher. In order to address these concerns, the present invention provides users with a training aide designed to identify a strike zone for batting and pitching practice.

SUMMARY OF THE INVENTION

In view of the foregoing disadvantages inherent in the known types of strike zone training devices now present in the prior art, the present invention provides a strike zone training device wherein the same can be utilized for providing convenience for the user when defining a strike zone for pitching or batting practice.

The present system comprises a base stand. A vertical shaft extends upward from the base stand. A first horizontal bar extends laterally outward from the vertical shaft. A second horizontal bar extends laterally outward from the vertical shaft. The first horizontal bar is positioned at a greater vertical elevation than the second horizontal bar. The first horizontal bar and the second horizontal bar can be vertically adjusted along the length of the vertical shaft. The first horizontal bar and the second horizontal bar are rotatable around the vertical shaft. The first horizontal bar and the second horizontal bar define a strike zone in between. As such, the strike zone can be adjustably defined according to the needs and preferences of the individual practicing.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
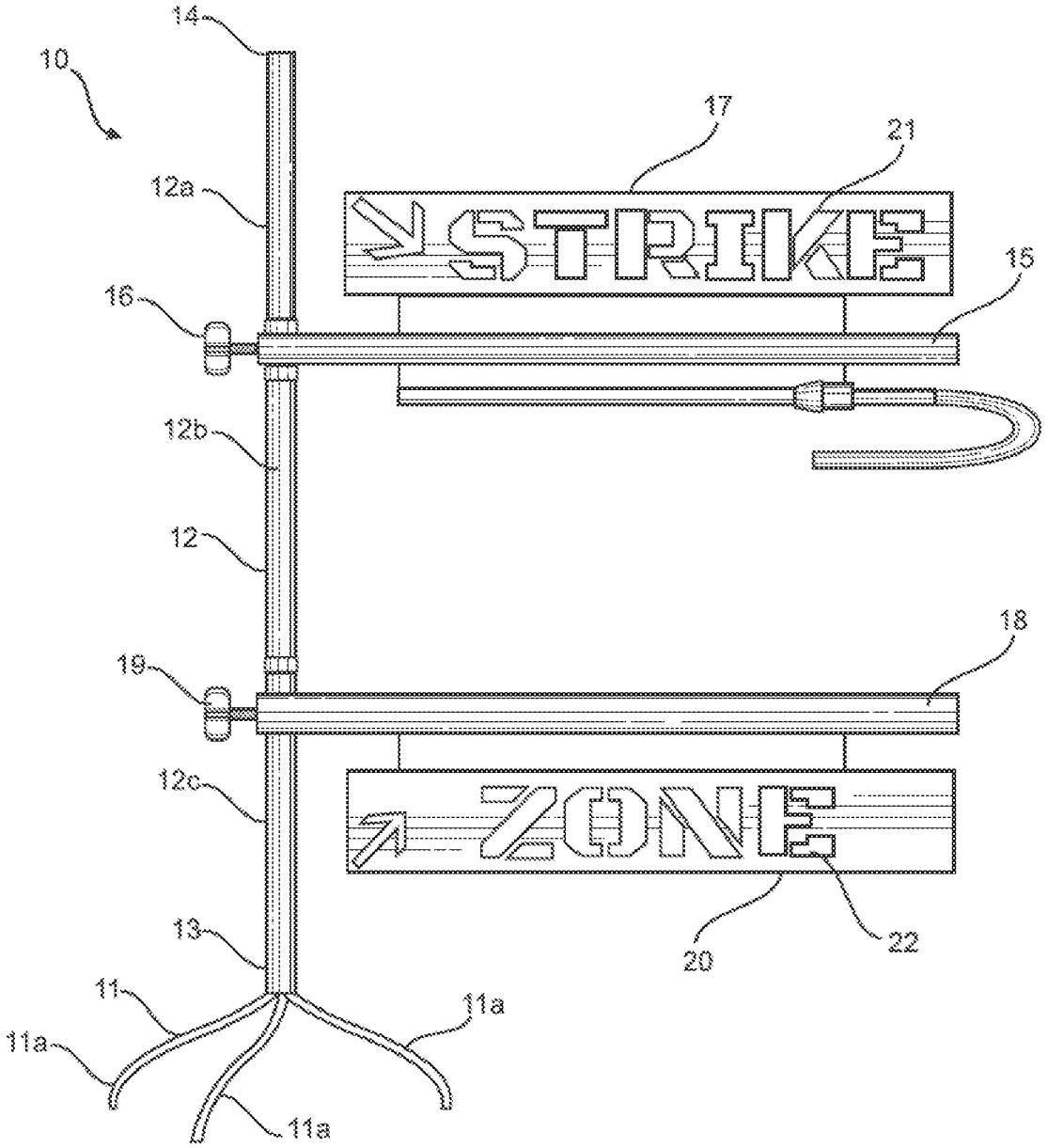
FIG. 1 shows a perspective view of an embodiment of the hitting and pitching training device.

Reference is made herein to the attached drawings. Like reference numerals are used throughout the drawings to depict like or similar elements of the hitting and pitching training device. The figures are intended for representative purposes only and should not be considered to be limiting in any respect.

Referring now to FIG. 1, there is shown a perspective view of an embodiment of the hitting and pitching training device. The hitting and pitching training device 10 comprises a base stand 11. A vertical shaft 12 extends upward from the base stand 11. The vertical shaft 12 comprises a bottom end 13 disposed oppositely a top end 14. The bottom end 13 of the vertical shaft 12 is secured to the base stand 11. The bottom end 13 of the vertical shaft 12 may be permanently bonded to the base stand 11 or may be removably secured to the base stand 11 via an interface, such as to allow for the hitting and pitching training device 10 to be disassembled for storage or transportation. In the illustrated embodiment, the base stand 11 comprises a plurality of base legs 11*a*. The plurality of base legs 11*a* comprise points configured to secure the position of the hitting and pitching training device 10. In alternate embodiments, the base stand 11 may comprise a circular plate or some other suitable structure. The base stand 11 must be of a suitable configuration for providing anchored support for the remaining elements of the hitting and pitching training device 10.

The vertical shaft 12 extends upward from the base stand 12. Ideally, the vertical shaft 12 will be substantially perpendicular to the surface on which the hitting and pitching training device 10. In the illustrated embodiment, the vertical shaft 12 is telescopically adjustable. As such, the height of the vertical shaft 12 may be adjusted by the user. Additionally, when the vertical shaft 12 is telescopically adjustable, convenience is provided to the user when storing or transporting the vertical shaft 12. In the demonstrated embodiment, the vertical shaft 12 is telescopic via a plurality of segments 12*a*, 12*b*, 12*c* of increasing large diameters from the top end 14 vertical shaft 12 to the bottom end 13 of the vertical shaft 12. In illustrated embodiment, the plurality of segments 12*a*, 12*b*, 12*c* consists of three segments, however, in alternate embodiments, more or less segments may be utilized.

A first horizontal bar 15 extends laterally from the vertical shaft 12. The first horizontal bar 15 is configured to define an upper vertical elevation of the hitting and pitching training device 10. The first horizontal bar 15 is vertically adjustable along the length of the vertical shaft 12. As such, the user may adjust the height of the first horizontal bar 15 relative to the ground surface on which the hitting and pitching training device 10 is placed. Furthermore, the first horizontal bar 15 is rotatable around the vertical shaft 12, such as to enable the user to change whether the first horizontal bar 15 extends from the left side or the right side of the vertical shaft 12. In the illustrated embodiment, the position of the first horizontal bar 15 is securable via a first knob 16. The first knob 16 can be loosened to allow for horizontal rotation and vertical movement of the first horizontal bar 15. In some embodiments, the first horizontal bar 15 is extendable, such as to define a longer area.

A second horizontal bar 18 extends laterally from the vertical shaft 12. The second horizontal bar 18 is configured to define a lower vertical elevation of the hitting and pitching training device 10. The second horizontal bar 18 is vertically adjustable along the length of the vertical shaft 12. As such, the user may adjust the height of the second horizontal bar 18 relative to the ground surface on which the hitting and pitching training device 10 is placed. Furthermore, the second horizontal bar 18 is rotatable around the vertical shaft 12, such as to enable the user to change whether the second horizontal bar 18 extends from the left side or the right side of the vertical shaft 12. In the illustrated embodiment, the position of the second horizontal bar 18 is securable via a second knob 19. The second knob 19 can be loosened to allow for horizontal rotation and vertical movement of the second horizontal bar 18. In some embodiments, the second horizontal bar 18 is extendable, such as to define a longer area.

In the illustrated embodiment, a first bracket 17 is disposed on the top surface of the first horizontal bar 15. Furthermore, in the demonstrated embodiment, a second bracket 20 is disposed on the lower surface of the second horizontal bar 18. The first bracket 17 and the second bracket 20. The first bracket 17 and the second bracket 20 are configured to increase the visual profile of the first horizontal bar 15 and the second horizontal bar 18, respectively. In some embodiments, the first bracket 17 comprises a first indicia 21 and the second bracket 20 comprises a second indicia 22. In some embodiments, the first indicia 21 is visually distinct from the second indicia 22, such that the appearance of the first horizontal bar 15 will be distinguished from the appearance of the second horizontal bar 18.

Figure 2:
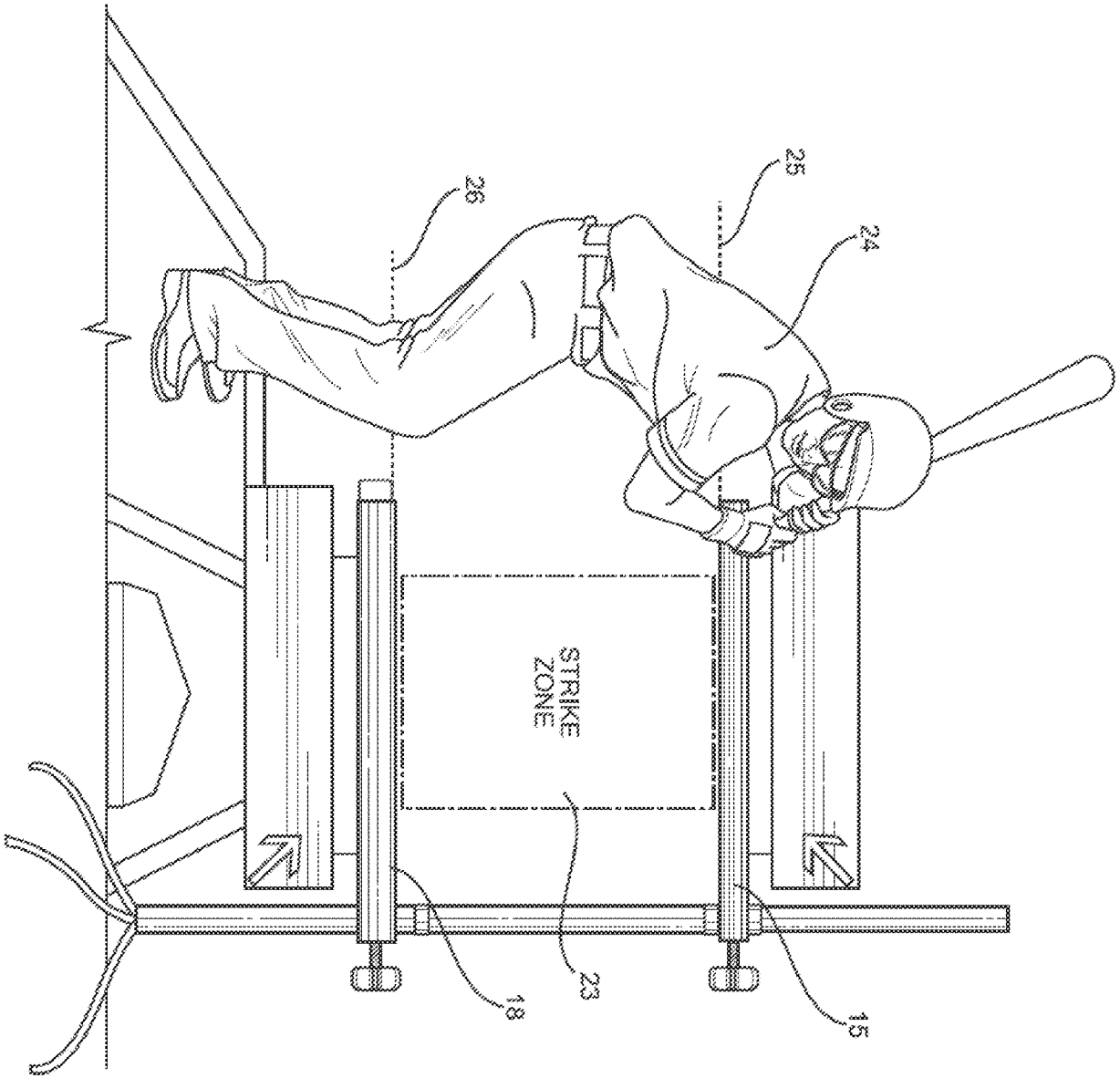
FIG. 2 shows a demonstrative view of an embodiment of the hitting and pitching training device.

Referring now to FIG. 2, there is shown a demonstrative view of an embodiment of the hitting and pitching training device. The first horizontal bar 15 is disposed at a greater vertical elevation than the second horizontal bar 18. The first horizontal bar 15 and the second horizontal bar 18 define a strike zone 23 therebetween. Since the first horizontal bar 15 and the second horizontal bar 18 are vertically adjustable, the defined strike zone 23 may be made larger or smaller as desired. Since the first horizontal bar 15 and the second horizontal bar 18 are horizontally rotatable, they can be adjusted to define a strike zone 23 of a right handed batter or a left handed batter as desired.

The strike zone 23, generally, is defined by the relative proportions of a batter 24. The top boundary 25 of the strike zone 23 is defined at the midpoint between the top of the batter's 24 shoulders and the top of the batter's 24 pants. As such, the first horizontal bar 15 would be set to the define the top boundary 25 of the strike zone 23. The lower boundary 26 of the strike zone 23 is defined at the hollow beneath the batter's 24 knee cap. Thus, the second horizontal bar 18 would be set to define the lower boundary 26 of the strike zone 23.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hitting and pitching training device to identify a strike zone for batting and pitching practice, comprising:

a base stand;

a vertical shaft extending upward from the base stand;

a first horizontal bar extending laterally outward from the vertical shaft;

a second horizontal bar extending laterally outward from the vertical shaft;

the first horizontal bar disposed at a greater vertical elevation than the second horizontal bar;

wherein the first horizontal bar and the second horizontal bar are vertically adjustable along the length of the vertical shaft;

wherein the first horizontal bar and the second horizontal bar are rotatable around the vertical shaft;

wherein the first horizontal bar and the second horizontal bar define the strike zone therebetween;

wherein the first horizontal bar comprises a first bracket thereon;

wherein the second horizontal bar comprises a second bracket thereon;

wherein the first horizontal bar comprises a first indicia thereon and the second horizontal bar comprises a second indicia thereon; and wherein the first indicia is visually distinct from the second indicia.

2. The hitting and pitching training device to identify a strike zone for batting and pitching practice of claim 1, wherein the vertical shaft is telescopically adjustable.

3. The hitting and pitching training device to identify a strike zone for batting and pitching practice of claim 1, wherein the first horizontal bar is secured to the vertical shaft via a first knob.

4. The hitting and pitching training device to identify a strike zone for batting and pitching practice of claim 1, wherein the second horizontal bar is secured to the vertical shaft via a second knob.

5. The hitting and pitching training device to identify a strike zone for batting and pitching practice of claim 1, wherein the first horizontal bar is extendable.

6. The hitting and pitching training device to identify a strike zone for batting and pitching practice of claim 1, wherein the second horizontal bar is extendable.

7. The hitting and pitching training device to identify a strike zone for batting and pitching practice of claim 1, wherein the base comprises a plurality of base legs.

* * * * *